United States Patent [19]

Brooks

[11] Patent Number: 4,890,841

[45] Date of Patent: Jan. 2, 1990

[54] GOLF SWING AID

[76] Inventor: Mark Brooks, 1320 Virginia Pl., Fort Worth, Tex. 76107

[21] Appl. No.: 308,535

[22] Filed: Feb. 10, 1989

[51] Int. Cl.[4] ..... A63B 69/36

[52] U.S. Cl. ..... 273/188 R; 273/189 R

[58] Field of Search ..... 273/188 R, 188 A, 189 R, 273/189 A, 190 R, 190 A, 190 B, 190 C, 183 B, 54 B, DIG. 30; 128/869, 878

[56] References Cited

U.S. PATENT DOCUMENTS

| | | | |
|---|---|---|---|
| 1,699,219 | 7/1928 | Bemish et al. | 273/189 R |
| 2,093,153 | 11/1937 | McCarthy | 273/189 R |
| 2,425,489 | 8/1947 | Peterson | 273/189 R |
| 2,808,267 | 5/1956 | Heaton | 273/189 R |
| 3,324,851 | 6/1967 | Posner | 273/189 R X |
| 3,419,277 | 12/1968 | Martin | 273/189 R |
| 3,679,214 | 7/1972 | Boyte | 273/189 R |
| 3,970,316 | 7/1976 | Westmoreland, Jr. | 273/189 R |
| 4,061,340 | 12/1977 | Husted | 273/189 R |
| 4,691,924 | 9/1987 | Strong | 273/189 R |
| 4,706,957 | 11/1987 | Jackson | 273/188 R |

*Primary Examiner*—George J. Marlo

*Attorney, Agent, or Firm*—Charles D. Gunter, Jr.

[57] ABSTRACT

A golf swing is shown which includes a shoulder encircling elastic band which is secured about the shoulders and provides a primary directive force for the swing. A pair of arm encircling bands depend downwardly from the shoulder encircling band for engaging the arms and maintaining the position of the shoulder encircling band during use.

10 Claims, 2 Drawing Sheets

GOLF SWING AID

BACKGROUND OF THE INVENTION

1. Field of the Invention

This invention relates to golfing equipment and particularly to equipment for improving the golfers execution of a conventional golf stroke.

2. Description of the Prior Art

It is generally accepted in the art of golfing that the "swing arm", which is the right arm for right-handed golfers and the left arm for left-handed golfers, should be maintained close to the body. As a result, various prior art devices are known which feature harnesses, belts, and loops for restraining the arms. See for example, U.S. Pat. No. 2,808,267 to Heaton "Golf Practice, Arm Restraint"; U.S. Pat. No. 3,970,316 to Westmorland, Jr., "Golf Swing Restrictor" and; U.S. Pat. No. 3,419,277 to Martin "Elbow Bend Restraining Means". Other training aids for restricting arm movement are shown in U.S. Pat. No. 3,679,214, to Boyte, "Golf Club Swing Training Aid"; U.S. Pat. No. 2,093,153 to McCarthy, "Practice Device For Golfers". U.S. Pat. No. 3,324,851 also shows an arm restraining device having a body encircling belt and arm restraining loops.

Rather than restraining the arms, the present invention has as an object the provision of a swing aid for improving the swing of the golfer which encircles the shoulders. This device was designed and created to help a golfer create the movement and therefore the feeling of a one piece swing. After a player has been helped to establish the actual feeling of a one piece swing, it is much easier to repeat the action without wearing the device.

The one piece swing is created when a golfer uses the large muscles of his back and thighs in controlling the consistency of the swing. Since the large muscles of both the back and thighs are also the strongest muscles in a players body, they have a very limited range of motion, allowing them to move consistently in two directions, back and through. Contrarily, the hands, arms and shoulders contain a multitude of smaller muscles used for detail work. These smaller muscles are able to move in literally hundreds, possibly thousands of directions, making it a much more difficult task to develop consistency of movement. The device of the invention makes it nearly impossible for the player to swing the club with anything except the body, aiding in the development of the desired swing movement.

SUMMARY OF THE INVENTION

The golf swing aid of the invention includes an elongated, shoulder encircling elastic band for encircling both shoulders of a golfer and for providing the primary directive force for the swing. The shoulder encircling band includes an inner surface which engages the shoulder, an outer surface and upper and lower edges. Fastening means are provided for securing the shoulder encircling band about the shoulders to thereby define a closed loop. Positioning means, located on the shoulder encircling band, maintain the position of the shoulder encircling band about the shoulders during use, whereby the swing of the golfer is controlled and coordinated with the body and not by the arms.

Preferably, the positioning means are elastic, arm encircling bands which encircle each of the golfers arms to maintain the position of the shoulder encircling band about the shoulders during use. Each of the arm encircling bands includes an inner surface which contacts the golfers arms and an outer surface. The arm encircling bands are fastened about the arms to define a pair of closed rings. The closed rings extend inwardly with respect to the closed loop defined by the shoulder encircling band so that the closed rings are located within the confines of the closed loop when viewed from above. In order to allow for size adjustment, the arm encircling bands can be slidably mounted on the shoulder encircling band.

Additional objects, features and advantages will be apparent in the written description which follows.

DETAILED DESCRIPTION OF THE INVENTION

Figure 1:
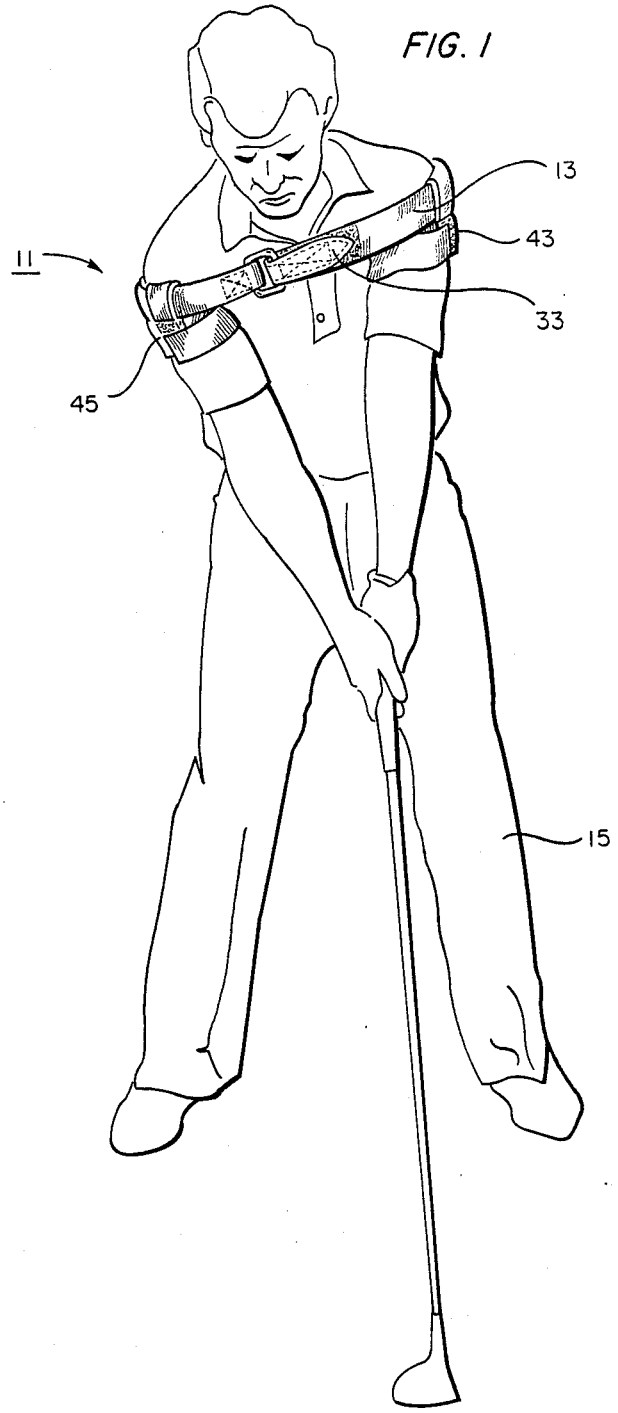
FIG. 1 is a perspective view of a golfer wearing the golf swing aid of the invention.
Figure 2:
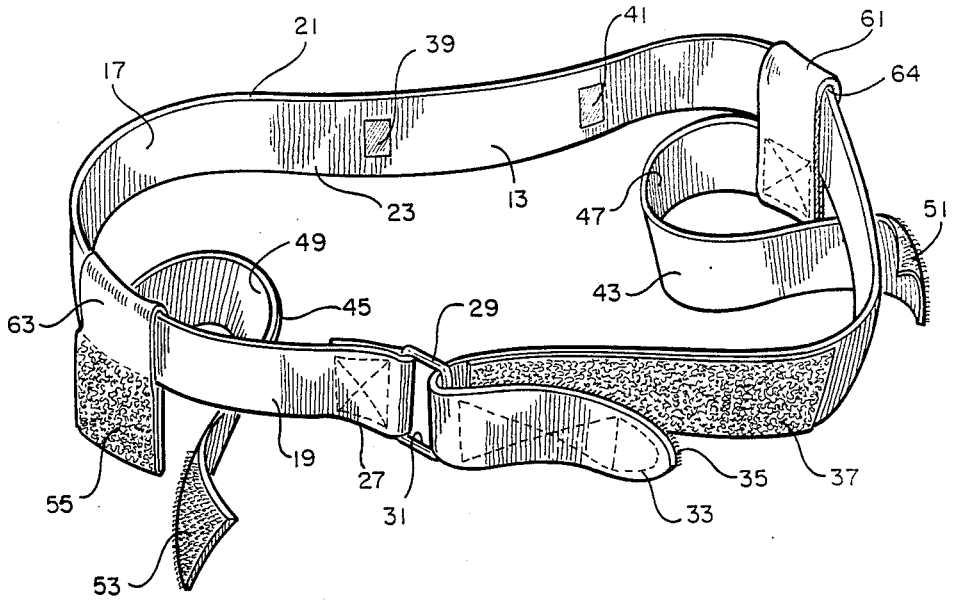
FIG. 2 is a perspective view of the golf swing aid with the fastening means for the shoulder encircling band secured and the fastening means for the arm encircling bands being open.

FIG. 1 shows the golf swing aid of the invention designated generally as 11. The swing aid 11, as shown in FIG. 2, includes an elongated shoulder encircling elastic band 13 for encircling both shoulders of a golfer 15 and for providing the primary directive force for the swing. The shoulder encircling band 13 includes an inner surface 17 an outer surface 19 and top and bottom edges 21, 23.

Figure 3:
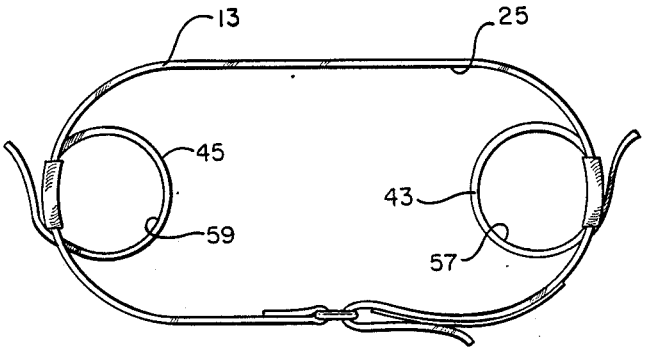
FIG. 3 is a top view of the swing aid of the invention showing the fastening means for the shoulder encircling band secured and the fastening means for the arm encircling bands secured.

Fastening means are provided for securing the shoulder encircling band 13 about the shoulders to define a closed loop (25 in FIG. 3). Preferably, the shoulder encircling band has a proximate end 27 provided with a buckle 29 having a buckle opening 31 adapted to receive a distal end 33 of the band. The distal end 33 of the band 13 is provided with mating Velcro surfaces 35, 37 for releasably securing the distal end 33 and the looped condition shown in FIG. 2. One of the Velcro surfaces 35, 37 is comprised of a plurality of hooks while the mating surface is provided with a plurality of loops or brush pile material for a press-fit engagement. The inner surface 17 of the shoulder encircling band 13 can also be provided with a plurality of tacky strips 39, 41 formed of rubber or other suitable material to make the band 13 adhere to the golfers clothes and maintain the position shown in FIG. 1.

The golf swing aid also includes positioning means located on the shoulder encircling band 13 for maintaining the position of the shoulder encircling band 13 about the shoulders during use. Preferably, an elastic, arm encircling band 43, 45 is provided for encircling each of the golfers arms to maintain the position of the shoulder encircling band 13 during use. It is important to note that band 13 does not encircle the trunk in order to hold bands 43, 45 in toward the trunk as in the prior art devices. Rather, band 13 encircles the shoulders with the arm bands 43, 45 merely serving to position the band during use. Each of the arm encircling bands 43, 45 has an inner surface 47, 49 and an outer surface 51, 53. Fastening means, such as mating Velcro surfaces 53, 55 are provided for securing the arm encircling bands 43, 45 about the arms to define a pair of closed rings 57, 59. As shown in FIG. 3, the rings are located within the confines of the closed loop 25 when viewed from above. The loops are not located on the exterior of the band 13, as in the prior art devices.

Preferably, the arm encircling bands 43, 45 depend downwardly below the botom edge 23 of the shoulder encircling band 13 by means of sleeve portions 61, 63. Each of the sleeve portions 61, 63 is provided with a sleeve opening 64 for receiving the shoulder encircling band 13, whereby the position of the arm encircling bands 43, 45 can be adjusted on the shoulder encircling band 13. If desired, the interior of each sleeve portion 61, 63 can be provided with fastening means, such as Velcro material, for engaging a mating area of Velcro on the shoulder encircling band 13 to retain the sleeve portions in the adjusted positions.

In use, the shoulder encircling band is positioned as shown in FIG. 1 with the band canted at an angle with respect to the vertical center line of the golfer. As shown in FIG. 1, the arm band 45 is lower on the right shoulder for a right-hand golfer. The shoulder encircling band is located entirely above the elbows of the golfer and secured in position by means of the mating Velcro surfaces of the band distal end 33. The position is maintained during use by arm bands 43, 45 which are engaged, as shown in FIG. 1 depending vertically downward from band 13 and positioned inwardly from the band 13 in the direction of the body.

An invention has been provided with several advantages. The swing aid of the invention produces a one piece swing using the body instead of the arms or hands. The golfer is encouraged to stroke through with the legs, back and torso rather than with the arms and hands.

A number of additional faults are corrected through the use of the device. For example, the use of the device of the invention will control "flying elbow" problems. These problems are created by the improper use and position of a right handed player's right elbow and a left handed player's left elbow. The device of the invention also teaches one the proper use of the left elbow in a right handed golfer and the right elbow in a left handed golfer. The proper use of the device of the invention will prevent "coming over the top" on the downswing, because it forces the player to use the large muscles of the body in the proper manner. A player is certain to make a backward movement of the golf swing on the correct "plane" with each swing of the club. The player can more easily "set the club at the top" because the club is not being swung with the hands and arms. Rather, the club is swung into position with the body and the player simply has to set the club or cock the wrist in preparation for the downswing. Unwanted forward movement of the upper body is almost entirely eliminated with the device of the invention. The device also corrects the fault of "crossing the line at the top" by making the player use the elbows in the proper fashion. The player cannot easily create a false release of the hands or a rolling over of the hands, since the club must be released "square" at impact. The elastic nature of the device allows the player to completely finish a backswing and completely finish the follow through. Each of the above listed advantages is a necessary by-product of the primary goal of the invention, to teach the most efficient and consistent method of using the body to create a sound golf swing.

While the invention has been shown in only one of its forms, it is not thus limited but is susepible to various changes and modifications without departing from the spirit thereof.

I claim:

1. A golf swing aid for improving the swing of a golfer, comprising:

an elongated, shoulder encircling elastic band for encircling both shoulders of a golfer and for providing the primary directive force for the swing, said shoulder encircling band including an inner surface which engages said shoulders, an outer surface and upper and lower edges;

fastening means for securing said shoulder encircling band about said shoulders to thereby define a closed loop;

positioning means located on said shoulder encircling band for maintaining the position of said shoulder encircling band about the shoulders during use, whereby the swing of a golfer is controlled and coordinated with the body and not by the arms.

2. A golf swing aid for improving the swing of a golfer, comprising:

an elongated, shoulder encircling elastic band for encircling both shoulders of a golfer and for providing the primary directive force for the swing, said band including an inner surface which engages said shoulders, an outer surface and upper and lower edges;

fastening means for securing said shoulder encircling band about said shoulders to thereby define a closed loop;

an elastic, arm encircling band for encircling each of said golfers arms to maintain the position of said shoulder encircling band about the shoulders during use, each of said arm encircling bands including an inner surface which contacts the golfers arms and an outer surface;

fastening means for securing said arm encircling bands about said arms to thereby define a pair of closed rings, said closed rings extending inwardly with respect to said closed loop so that said closed rings are located within the confines of said closed loop when viewed from above, whereby the swing of a golfer is controlled and coordinated with the body and not by the arms.

3. The golf swing aid of claim 2, wherein said arm encircling bands are slidably mounted on said shoulder encircling band.

4. A golf swing aid for improving the swing of a golfer, comprising:

an elongated, shoulder encircling elastic band for encircling both shoulders of a golfer and for providing the primary directive force for the swing, said band including an inner surface which engages said shoulders, an outer surface and upper and lower edges;

fastening means for securing said shoulder encircling band about said shoulders to thereby define a closed loop;

a pair of elastic, arm encircling bands depending downwardly below the lower edge of said shoulder encircling band to maintain the position of said shoulder encircling band about the shoulders during use, each of said arm encircling bands including an inner surface which contacts the golfers arms and an outer surface;

fastening means for securing said arm encircling bands about said arms to thereby define a pair of closed rings, said closed rings depending downwardly and extending inwardly with respect to said closed loop so that said closed rings are located within the confines of said closed loop when viewed from above, whereby the swing of a golfer is controlled and coordinated with the body and not by the arms.

5. The golf swing aid of claim 4, wherein said shoulder encircling band has a proximate end and a distal end, said proximate end being provided with a buckle having a buckle opening adapted to receive the distal end of said shoulder encircling band when said distal end is looped through said opening, said distal end being provided with mating press-fit surfaces for releasably securing said distal end in said looped condition.

6. The golf swing aid of claim 4, wherein each of said arm encircling bands has a proximate end which depends from said shoulder encircling band and a distal end, said proximate end and said distal ends being provided with mating press-fit surfaces on the exterior and interior surfaces thereof, respectively, for securing said arm encircling bands about said arms.

7. The golf swing aid of claim 6, wherein the proximate end of said arm encircling bands includes a sleeve portion with a sleeve opening for receiving said shoulder encircling band, whereby the position of said arm encircling bands can be adjusted on said shoulder encircling band.

8. A method for improving the swing of a golfer, comprising the steps of:

providing an elongated, shoulder encircling elastic band for encircling both shoulders of a golfer and for providing the primary directive force for the swing, said shoulder encircling band including an inner surface which engages said shoulders and an outer surface;

positioning said shoulder encircling band entirely above the elbows of said golfer and securing said shoulder encircling band about said shoulders to thereby define a closed loop;

maintaining the position of said shoulder encircling band about the shoulders and above the elbows during use, whereby the swing of the golfer is controlled and coordinated with the body and not by the arms.

9. The method of claim 8, wherein said shoulder encircling band is canted at an angle with respect to a vertical centerline of the golfer's body, the band being lower to the ground on the right shoulder for a right handed golfer.

10. The method of claim 9, further comprising the steps of:

providing a pair of arm encircling bands on said shoulder encircling band and securely positioning said shoulder encircling band during use by looping said arm bands about the arms of the golfer, the loops being located inward with respect to the confines of the shoulder encircling band.

* * * * *